US008360402B2

(12) United States Patent
Sugitani et al.

(10) Patent No.: US 8,360,402 B2
(45) Date of Patent: Jan. 29, 2013

(54) MULTI-PRESSURE CONDENSER AND CONDENSATE REHEATING METHOD

(75) Inventors: Naoki Sugitani, Kanagawa (JP); Koichi Yoshimura, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 484 days.

(21) Appl. No.: 12/754,972

(22) Filed: Apr. 6, 2010

(65) Prior Publication Data

US 2010/0319879 A1 Dec. 23, 2010

Related U.S. Application Data

(63) Continuation-in-part of application No. PCT/JP2008/002928, filed on Oct. 16, 2008.

(30) Foreign Application Priority Data

Oct. 16, 2007 (JP) ..... 2007-269555

(51) Int. Cl.
*B01F 3/04* (2006.01)

(52) U.S. Cl. ..... 261/113; 261/141; 261/146; 261/157; 261/DIG. 10

(58) Field of Classification Search ..... 261/141, 261/113, 146, 157, DIG. 10
See application file for complete search history.

(56) References Cited

U.S. PATENT DOCUMENTS

| | | | |
|---|---|---|---|
| 6,814,345 | B2 | 11/2004 | Inoue |
| 7,111,832 | B2 | 9/2006 | Inoue |
| 2003/0090010 | A1 | 5/2003 | Inoue |
| 2005/0034455 | A1 | 2/2005 | Inoue |

FOREIGN PATENT DOCUMENTS

| | | | |
|---|---|---|---|
| JP | 50-153110 | A | 12/1975 |
| JP | 54-033906 | A | 3/1979 |
| JP | 61-011590 | A | 1/1986 |
| JP | 61-168787 | A | 7/1986 |
| JP | 61-265489 | A | 11/1986 |
| JP | 11-173768 | A | 7/1999 |
| JP | 2003-148876 | A | 5/2003 |
| JP | 2003-185359 | A | 7/2003 |
| JP | 3706571 | B2 | 8/2005 |

*Primary Examiner* — Robert A Hopkins
(74) *Attorney, Agent, or Firm* — Foley & Lardner LLP

(57) ABSTRACT

A multi-pressure condenser has first and second condensers with vacuum pressures. The second condenser has a higher pressure. The first condenser has a first cooling water tube bundle, and a pressure barrier which extends below the first cooling water tube bundle. A heat-transfer tube introduces fluid from outside the first condenser into the first hot well below the barrier. Liquid is dropped into the first hot well through the through holes of the pressure barrier. The second condenser has a second cooling water tube bundle. Condensate generated in the high-pressure chamber is accumulated below the second cooling water tube bundle. The multi-pressure condenser further has a steam duct to connect the gas phase parts of the first hot well and the second condenser, and a pipe to communicate the liquid phase parts of the first hot well and the second condenser.

7 Claims, 5 Drawing Sheets

MULTI-PRESSURE CONDENSER AND CONDENSATE REHEATING METHOD

CROSS REFERENCES TO RELATED APPLICATIONS

This application is a continuation-in-part (CIP) application based upon the International Application PCT/JP2008/02928, the International Filing Date of which is Oct. 16, 2008, the entire content of which is incorporated herein by reference, and claims the benefit of priority from the prior Japanese Patent Application No. 2007-269555, filed in the Japanese Patent Office on Oct. 16, 2007, the entire content of which is incorporated herein by reference.

BACKGROUND OF THE INVENTION

The present invention relates to a multi-pressure condenser constructed by combining a plurality of shells having different internal pressures.

A condenser used in a nuclear power plant or a thermal power plant has a function of cooling and condensing a turbine exhaust that has been used for an expansion work through a steam turbine to convert it into condensate. The condensate generated in the condenser is fed back to the steam turbine through a feed-water heater and a steam generator. The inside of such a condenser is maintained in a vacuum, and the higher the degree of vacuum, the more the heat consumption rate of the turbine is increased to thereby improve plant efficiency. A typical condenser has a steam turbine at its upper portion and retains the condensate on the bottom side.

The condensate that has been fed from the condenser to the feed-water heater is heated in the feed-water heater by extraction steam from the steam turbine and is then fed to a boiler. At this time, the higher the temperature of the condensate to be fed to the feed-water heater, the more the amount of turbine extraction steam can be reduced, thereby improving plant efficiency.

As an apparatus for increasing the temperature of condensate to be fed to the feed-water heater, there is known a multi-pressure condenser constructed by connecting a plurality of condensers having different internal pressures (Refer to, e.g., Japanese Patent No. 3,706,571, the entire content of which is incorporated herein by reference).

Such a type of condenser will be described in detail with reference to FIG. 5. FIG. 5 is an enlarged vertical cross-sectional view illustrating the outline of a conventional multi-pressure condenser.

A high-pressure stage condenser 101 and a low-pressure stage condenser 103 are connected by a steam duct 110 and a bypass connecting pipe 117. The high-pressure stage condenser 101 has a high-pressure chamber 105 surrounded by a high-pressure shell 102. The low-pressure stage condenser 103 has two chambers defined by a perforated plate 113 provided below a cooling water tube bundle 107 and a low-pressure shell 104: one is a low-pressure chamber 106 defined on the upper side of the perforated plate 113 and the other is a reheat chamber 111 defined on the lower side of the perforated plate 113. Cooling water flowing in the cooling water tube bundle 107 passes through the low-pressure chamber 106 and is introduced into the high-pressure chamber 105. Thus, the temperature of the cooling water is set higher in the low-pressure chamber 106 than in the high-pressure chamber 105, and the pressure of the high-pressure chamber 105 is set higher than that of the low-pressure chamber 106. Further, a tray 115 is provided below the perforated plate 113. Condensate is accumulated in the bottom portions of the high-pressure chamber 105 and the reheat chamber 111.

The steam duct 110 allows the high-pressure chamber 105 and the reheat chamber 111 to communicate with each other, and the bypass connecting pipe 117 guides condensate accumulated in the lower portion of the high-pressure shell 102 to a merger portion 116.

Operational effects of the multi-pressure condenser having such a configuration will be described below.

A turbine exhaust is fed from above the high-pressure stage condenser 101 and the low-pressure stage condenser 103. The turbine exhaust is cooled by the cooling water tube bundle 107 and condensed into condensate.

In the high-pressure stage condenser 101, the condensed condensate is accumulated in the bottom portion of the high-pressure chamber 105. In the low-pressure stage condenser 103, the condensate is accumulated on the perforated plate 113 and dropped to the reheat chamber 111 through holes 114 formed in the perforated plate 113. The perforated plate 113 on which the condensate has been accumulated functions as a pressure barrier between the low-pressure chamber 106 and the reheat chamber 111 to separate the pressure in the low-pressure chamber 106 and the pressure in the reheat chamber 111.

In the reheat chamber 111, the condensate is dropped from the perforated plate 113 to the tray 115 and is further dropped from the end portion of the tray 115 to the bottom portion of the reheat chamber 111. Steam of the high-pressure chamber 105 has been introduced into the gas phase part of the reheat chamber 111 through the steam duct 110. The steam in the high-pressure chamber 105 has a higher pressure than the condensate that has been condensed in the low-pressure chamber 106 and therefore has a high saturation temperature. Thus, it is possible to increase the temperature of the condensate that has been condensed in the low-pressure chamber 106 by reheating the condensate with the steam in the high-pressure chamber 105.

The existence of the tray 115 increases the surface area of the condensate from the phase where the condensate is dropped to the reheat chamber 111 to the place where it is accumulated in the bottom portion of the reheat chamber 111, thereby accelerating heat exchange between the steam and condensate.

The condensate that has been condensed in the high-pressure stage condenser 101 is fed to the merger portion 116 by the bypass connecting pipe 117 and is merged with the condensate of the reheat chamber 111 followed by feeding to a not-illustrated feed-water heater.

According to the multi-pressure condenser having such a configuration, it is possible to obtain the following effects: the temperature of the condensate can be increased; the average value of the turbine exhaust pressure becomes lower than that in a single-pressure type condenser in which all condensers have the same pressure value to increase turbine heat drop; and a difference between the saturation steam temperature of each condenser and the cooling water outlet temperature can be made larger to thereby reduce the condenser cooling area.

As described above, the multi-pressure condenser uses the steam in the high-pressure condenser as a heat source so as to improve plant efficiency. However, in the case where only the steam in the high-pressure condenser is used as a heat source, it is difficult to heat the condensate up to the saturation temperature of the pressure of the high-pressure condenser.

BRIEF SUMMARY OF THE INVENTION

An object of the present invention is therefore to provide a multi-pressure condenser capable of improving plant efficiency more than a conventional multi-pressure condenser that uses only the steam in the high-pressure condenser as a heat source of the condensate.

In order to achieve the object, according to the present invention, there is presented a multi-pressure condenser having a first condenser inside which a vacuum low-pressure chamber is formed and a second condenser inside which a vacuum high-pressure chamber having a higher pressure than the low-pressure chamber is formed, the first condenser comprising: a first cooling water tube bundle provided with a plurality of tubes which are provided so as to penetrate the low-pressure chamber and in which cooling water is distributed; a pressure barrier which extends in horizontal direction below the first cooling water tube bundle so as to separate internal space of the first condenser into upper and lower portions, the upper portion defining the low-pressure chamber and the lower portion defining a first hot well, and which has a plurality of through holes; and a heat-transfer tube inside which fluid introduced from outside the first condenser into the first hot well is distributed, wherein a gas phase part and a liquid phase part are formed respectively at the upper and the lower portions of the low-pressure chamber, and liquid in the liquid phase part is dropped into the first hot well through the plurality of through holes to form a gas phase part and a liquid phase part at the upper and the lower portions of the first hot well, the second condenser comprising: a second cooling water tube bundle provided with a plurality of tubes which are provided so as to penetrate the high-pressure chamber and in which cooling water is distributed, wherein condensate generated in the high-pressure chamber is accumulated below the second cooling water tube bundle to form a liquid phase part, and a gas phase part is formed above the liquid phase part, and the multi-pressure condenser further comprising: a steam duct allowing the gas phase parts of the first hot well and the second condenser to communicate with each other; and a pipe allowing the liquid phase parts of the first hot well and the second condenser to communicate with each other, wherein fluid having a higher temperature than the condensate accumulated in the first hot well is fed to the heat-transfer tube.

According to the present invention, there is also presented a method of reheating condensate of a multi-pressure condenser comprising a first condenser inside which a vacuum low-pressure chamber is formed and a second condenser inside which a vacuum high-pressure chamber having a higher pressure than the low-pressure chamber is formed, the first condenser comprising: a first cooling water tube bundle provided with a plurality of tubes which are provided so as to penetrate the low-pressure chamber and in which cooling water is distributed; a pressure barrier which extends in horizontal direction below the first cooling water tube bundle so as to separate internal space of the first condenser into upper and lower portions, the upper portion defining the low-pressure chamber and the lower portion defining a first hot well, and which has a plurality of through holes; and a heat-transfer tube inside which fluid introduced from outside the first condenser into the first hot well is distributed, wherein a gas phase part and a liquid phase part are formed respectively at the upper and the lower portions of the low-pressure chamber, and liquid in the liquid phase part is dropped into the first hot well through the plurality of through holes to form a gas phase part and a liquid phase part at the upper and the lower portions of the first hot well, the second condenser comprising: a second cooling water tube bundle provided with a plurality of tubes which are provided so as to penetrate the high-pressure chamber and in which cooling water is distributed, wherein condensate generated in the high-pressure chamber is accumulated below the second cooling water tube bundle to form a liquid phase part, and a gas phase part is formed above the liquid phase part, the multi-pressure condenser further comprising: a steam duct allowing the gas phase parts of the first hot well and the second condenser to communicate with each other; and a pipe allowing the liquid phase parts of the first hot well and the second condenser to communicate with each other, and the method of reheating condensate of the multi-pressure condenser comprising: performing heat exchange between the vent, drain or extraction steam of at least one of: a feed-water heater for heating feed-water to be fed to a nuclear reactor pressure vessel, a deaerator for deaerating the feed-water to be fed to the nuclear reactor pressure vessel, a feed-water heater drain tank for storing drain of the feed-water heater, and a turbine for generating power using steam which is generated by heating the feed-water with heat generated in the nuclear reactor pressure vessel; and the condensate accumulated in the first hot well.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Embodiments of the present invention will be described below with reference to the accompanying drawings.

First Embodiment

Figure 1:
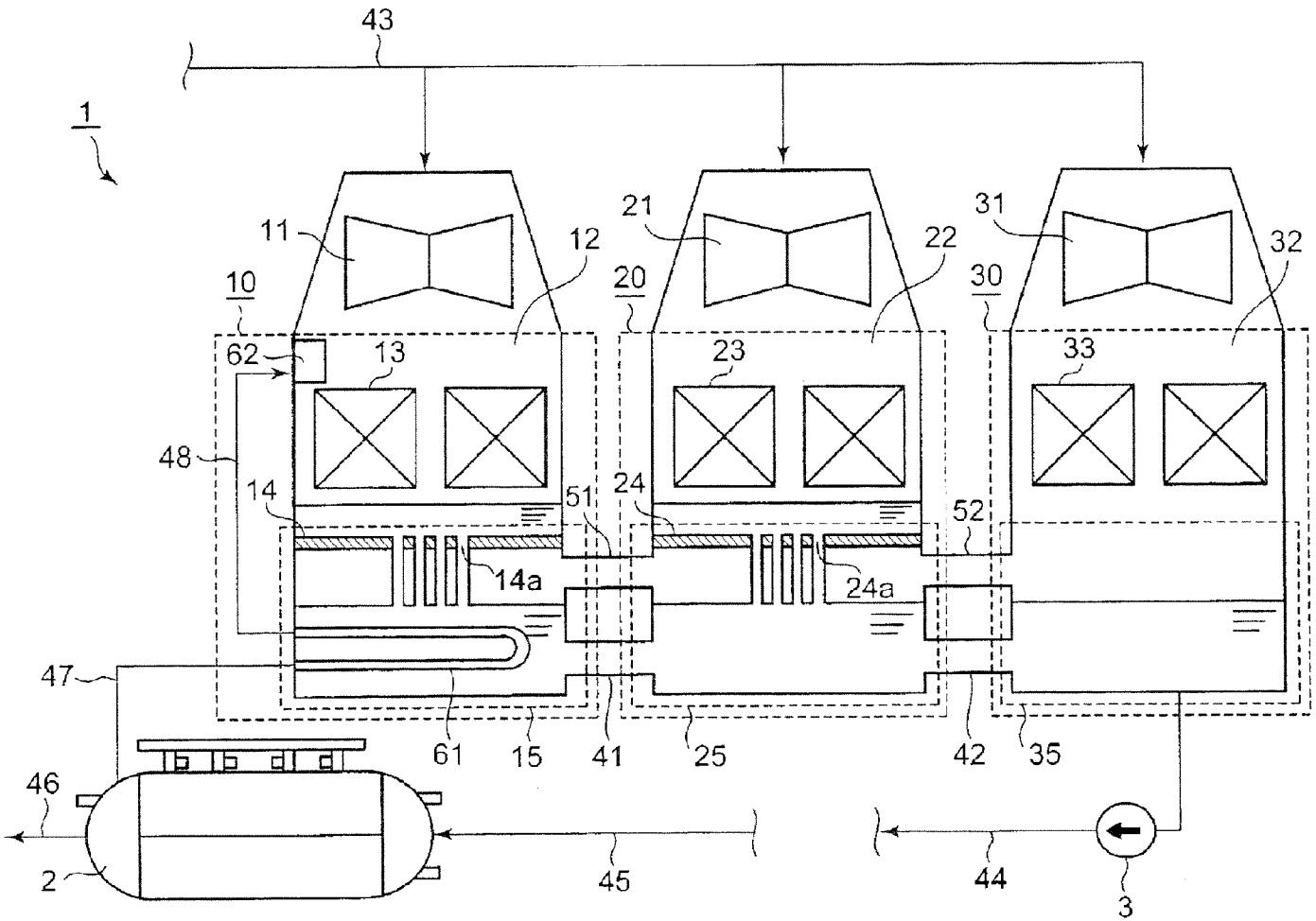
FIG. 1 is a block diagram illustrating the outline of a multi-pressure condenser according to a first embodiment of the present invention.

A multi-pressure condenser according to a first embodiment of the present invention will be described with reference to FIG. 1. FIG. 1 is a block diagram illustrating the outline of a multi-pressure condenser according to the present invention. A multi-pressure condenser 1 is constituted by, e.g., a three-shell condenser constructed by connecting three condensers: a low-pressure condenser 10, an intermediate pressure condenser 20, and a high-pressure condenser 30.

The low-pressure condenser 10, intermediate pressure condenser 20, and high-pressure condenser 30 respectively have low-pressure turbines 11, 21 and 31 mounted in the upper portion thereof and a low-pressure chamber 12, an intermediate pressure chamber 22, and a high-pressure chamber 32 formed below the low-pressure turbines 11, 21 and 31. The low-pressure turbines 11, 21 and 31 are each a turbine that receives exhaust steam from the high-pressure turbine and generates power. The low-pressure condenser 10, the intermediate pressure condenser 20 and the high-pressure condenser 30 further respectively have cooling water tube bundles 13, 23 and 33 passing through the low-pressure chamber 12, the intermediate pressure chamber 22 and the high-pressure chamber 32, respectively. The cooling water tube bundles 13, 23 and 33 form one continuous pipe line, and the cooling water passes through the cooling water tube bundles 13, 23 and 33 in the order mentioned. Cooling water that has cooled the steam in the low-pressure chamber 12 flows in the cooling water tube bundle 23, and the cooling water that has cooled the steam in the low-pressure chamber 12 and intermediate pressure chamber 22 flows in the cooling water tube bundle 33, so that the temperature of the cooling water becomes lower in the order of the cooling water tube bundle 13, the cooling water tube bundle 23, and the cooling water tube bundle 33. Therefore, the low-pressure chamber 12, intermediate pressure chamber 22 and the high-pressure chamber 32 have different pressures. That is, the low-pressure chamber 12 has the lowest pressure, and the high-pressure chamber 32 has the highest pressure.

Pressure barriers 14 and 24 are provided below the cooling water tube bundles 13 and 23, respectively. The pressure barriers 14 and 24 are horizontal flat plates respectively having a plurality of small holes (through holes) 14*a* and 24*a* and respectively constitute the bottom portions of the low-pressure chamber 12 and the intermediate pressure chamber 22.

Hot wells 15, 25 and 35 for accumulating condensate are formed in the bottom portions of the low-pressure condenser 10, the intermediate pressure condenser 20 and the high-pressure condenser 30, respectively. In the case of the low-pressure condenser 10 and the intermediate pressure condenser 20, the hot wells 15 and 25 are positioned below the pressure barriers 14 and 24, and in the case of the high-pressure condenser 30, the hot well 35 is positioned below the cooling water tube bundle 33. Since the pressure barrier does not exist in the high-pressure condenser 30, the high-pressure chamber 32 and the hot well 35 form one continuous space.

The hot wells 15 and 25 communicate with each other through a steam duct 51. The gas phases of the hot wells 25 and 35 communicate with each other through a steam duct 52, and the liquid phases thereof communicate with each other through a pipe 42.

The low-pressure turbines 11, 21 and 31 are connected to a not-illustrated high-pressure turbine through pipes 43. Further, a pipe 44 is connected to the hot well 35 of the high-pressure condenser 30. The pipe 44 is connected to a deaerator 2 through devices such as a main air extractor and a feed-water heater and a pipe 45. A configuration from the pipe 44 to the pipe 45 is not illustrated here. A pump 3 for driving the condensate is connected to the pipe 44.

The deaerator 2 deaerates the condenser fed through the pipe 45 using extraction steam from the high-pressure turbine. The deaerator 2 then feeds the deaerated condensate to a pipe 46 and discharges the high-pressure turbine extraction steam used for the deaeration to a vent pipe 47 as vent gas. The vent pipe 47 is connected to a heat-transfer tube 61 which is provided so as to pass through the condensate accumulated in the hot well 15. The heat-transfer tube 61 is connected to a pipe 48, and the pipe 48 is connected to a flush box 62 provided above the cooling water tube bundle 13 in the low-pressure condenser 10.

Operation of the multi-pressure condenser according to the present embodiment will be described below.

High-pressure turbine exhaust steam is fed to the low-pressure turbines 11, 21 and 31 through the pipes 43. The steam fed to the low-pressure turbines 11, 21 and 31 rotates the low-pressure turbines 11, 21 and 31. After that, the steam is fed to the low-pressure chamber 12, the intermediate pressure chamber 22 and the high-pressure chamber 32 of the low-pressure condenser 10, the intermediate pressure condenser 20 and the high-pressure condenser 30, and is cooled by the cooling water tube bundles 13, 23 and 33 and condensed into condensate. In the low-pressure condenser 10 and the intermediate pressure condenser 20, the condensate is dropped onto the pressure barriers 14 and 24, and is accumulated there. In the high-pressure condenser 30, the condensate is dropped in the hot well 35 and is accumulated there. The condensate accumulated on the pressure barriers 14 and 24 is dropped in the hot wells 15 and 25 through the holes formed in the pressure barriers 14 and 24, and is accumulated there. The condensate accumulated in the hot wells 15, 25 and 35 is fed by the drive of the pump 3 to the subsequent process through the pipe 44.

After passing through the pipe 44, a not-illustrated feed-water heater and the like, the condensate is introduced into the deaerator 2 through the pipe 45. The deaerator 2 deaerates the condensate using the high-pressure turbine extraction steam and feeds the deaerated condensate to the pipe 46 and discharges vent gas to the vent pipe 47. The condensate fed to the pipe 44 is fed as feed-water to a nuclear reactor through a not-illustrated high-pressure feed-water heater and the like. The vent gas discharged to the pipe 47 passes through the heat-transfer tube 61 provided in the hot well 15 and is fed to the flush box 62.

Operational effects of the multi-pressure condenser according to the present embodiment will be described below.

The pressure barrier 14 on which the condensate is accumulated prevents the steam from escaping from the hot well 15 to the low-pressure chamber 12 to separate the pressure in the low-pressure chamber 12 and the pressure in the hot well 15. Similarly, the pressure barrier 24 separates the pressure in the intermediate pressure chamber 22 and the pressure in the hot well 25. By the function of the pressure barriers 14 and 24, the steam in the hot well 35 is introduced into the gas phase parts of the hot wells 15 and 25 through the steam ducts 51 and 52. The temperatures of the condensate dropped in the hot wells 15 and 25 correspond respectively to the saturation temperatures of the pressures of the low-pressure chamber 12 and the intermediate pressure chamber 22 and a re lower than the temperature of the steam in the high-pressure condenser 30. Therefore, the condensate dropped in the hot wells 15 and 25 is heated by heat exchange with the steam introduced from the high-pressure chamber 32 into the gas phase parts of the hot wells 15 and 25.

Further, the condensate accumulated in the hot well 15 is heated by heat exchange with the vent gas, which has been discharged from the deaerator 2 and distributed in the heat-transfer tube 61. The vent gas in the heat-transfer tube 61 is cooled by heat exchange with the condensate to be condensed. The condensed vent gas is fed to the flush box 62 through the pipe 48 to become flush steam. The flush steam generated in the flush box 62 is merged with the exhaust steam in the low-pressure turbine 11. As described above, by using the vent gas from the deaerator 2 as a heat source of the condensate in addition to the steam from the high-pressure condenser 30, it is possible to increase the temperature of the condensate more effectively than ever before.

Second Embodiment

Figure 2:
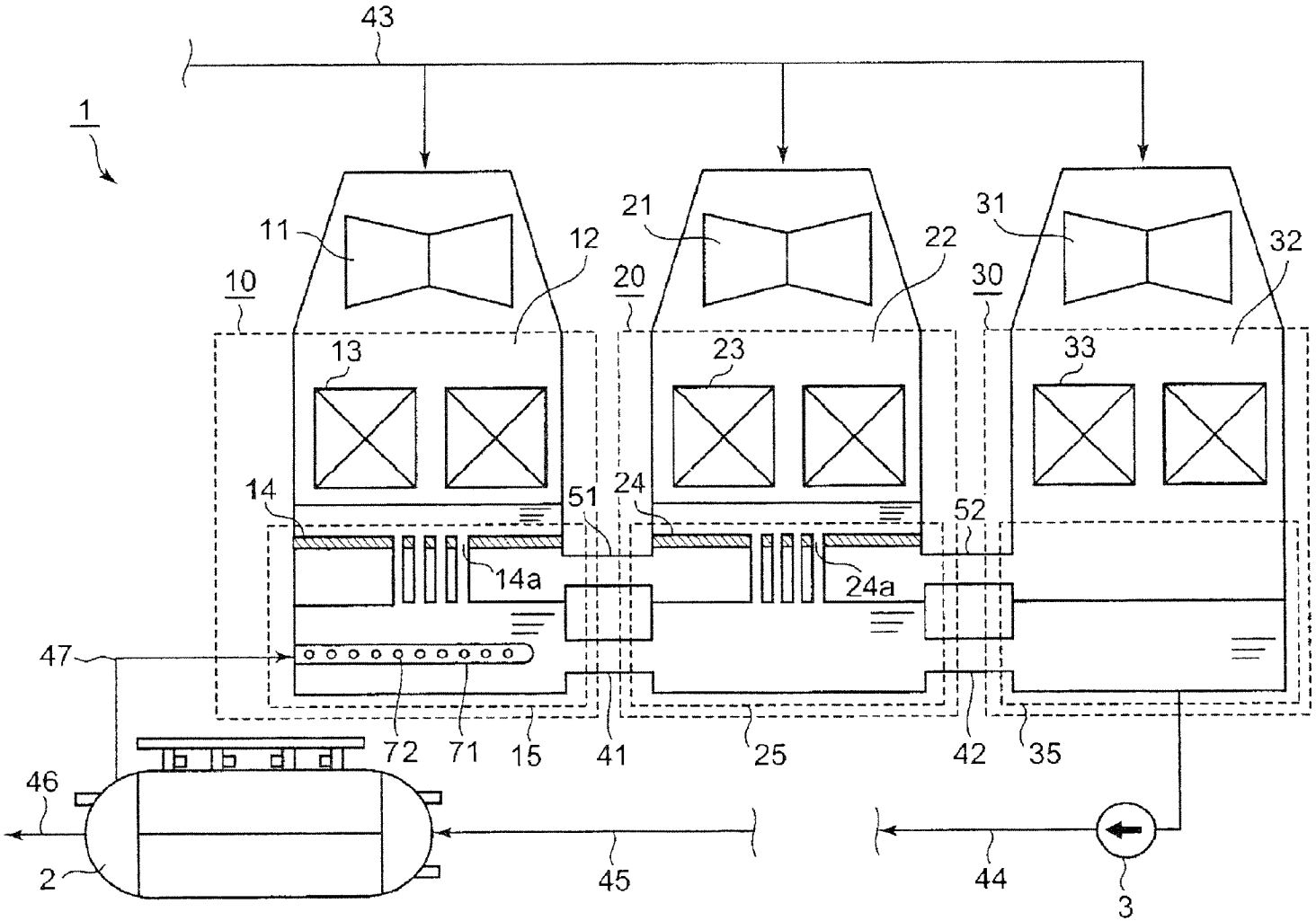
FIG. 2 is a block diagram illustrating the outline of a multi-pressure condenser according to a second embodiment of the present invention.

A multi-pressure condenser according to a second embodiment of the present invention will be described with reference to FIG. 2. FIG. 2 is a block diagram illustrating the outline of a multi-pressure condenser according to the present invention. The same reference numerals are given to the same parts as those in the first embodiment, and the overlapped description will be omitted.

In the present embodiment, the vent pipe 47 from the deaerator 2 is connected to a heat-transfer tube 71 provided in the hot well 15. The heat-transfer tube 71 is introduced into the condensate accumulated in the hot well 15. The heat-transfer tube 71 is constituted by a tube having a plurality of holes 72. Holes may be formed at the end portion of the heat-transfer tube 71, or the end portion may be closed.

The vent gas from the deaerator 2 is fed to the heat-transfer tube 71 through the pipe 47, blown out through the holes 72 of the heat-transfer tube 71, and mixed with the condensate in the hot well 15. By directly mixing high-temperature vent gas with the condensate, the condensate can be heated and deaerated simultaneously.

Third Embodiment

Figure 3:
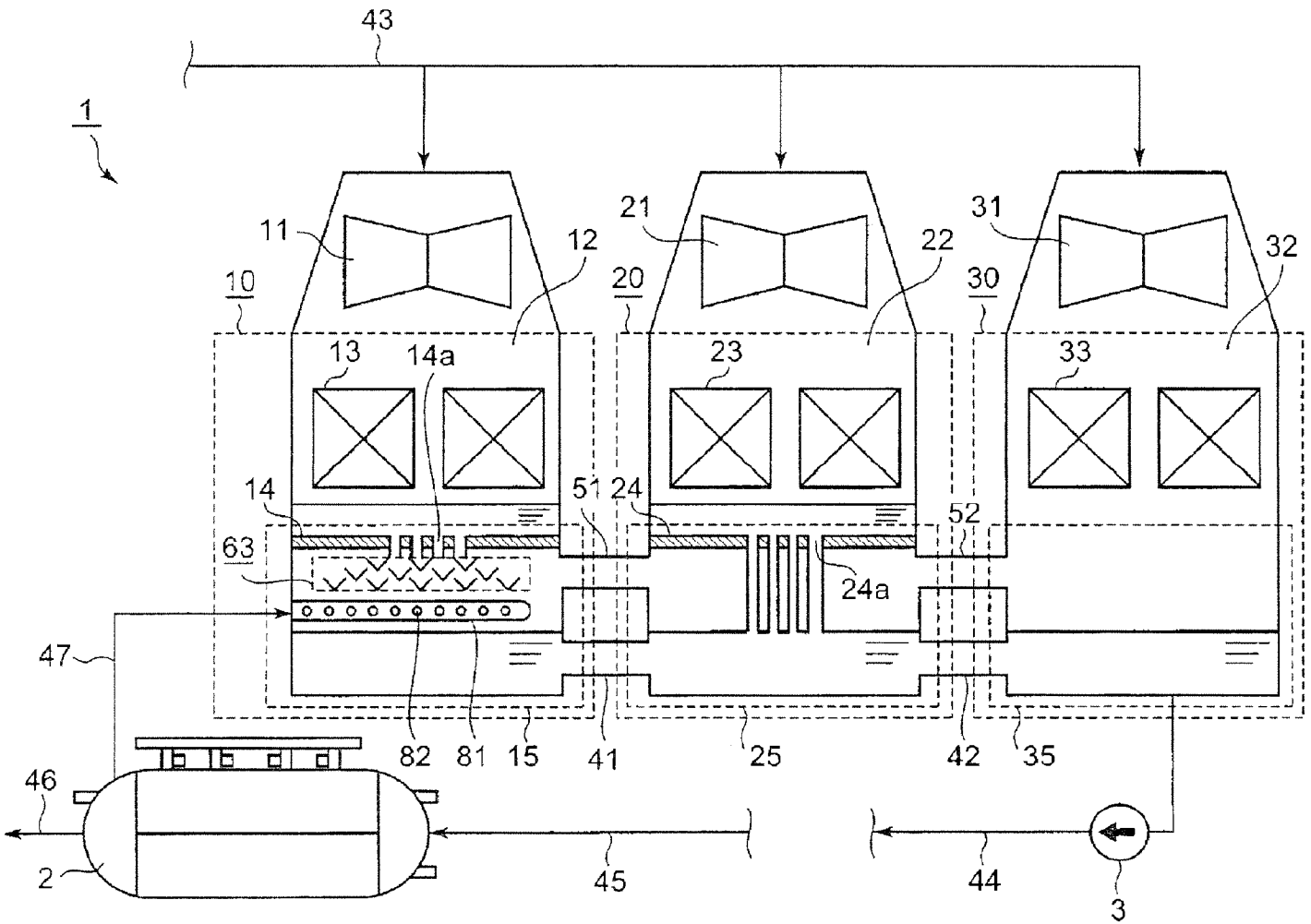
FIG. 3 is a block diagram illustrating the outline of a multi-pressure condenser according to a third embodiment of the present invention.

A multi-pressure condenser according to a third embodiment of the present invention will be described with reference to FIG. 3. FIG. 3 is a block diagram illustrating the outline of a multi-pressure condenser according to the present embodiment. The same reference numerals are given to the same parts as those in the first embodiment, and the overlapped description will be omitted.

In the present embodiment, the vent pipe 47 is connected to a heat-transfer tube 81 provided in the hot well 15. The heat-transfer tube 81 is constituted by a pipe having a plurality of holes 82. Holes may be formed at the end portion of the heat-transfer tube 81, or the end portion may be closed. The heat-transfer tube 81 extends in the gas phase part of the hot well 15. A deaerating tray 63 is provided between the pressure barrier 14 of the low-pressure condenser 10 and the heat-transfer tube 81.

Figure 4:
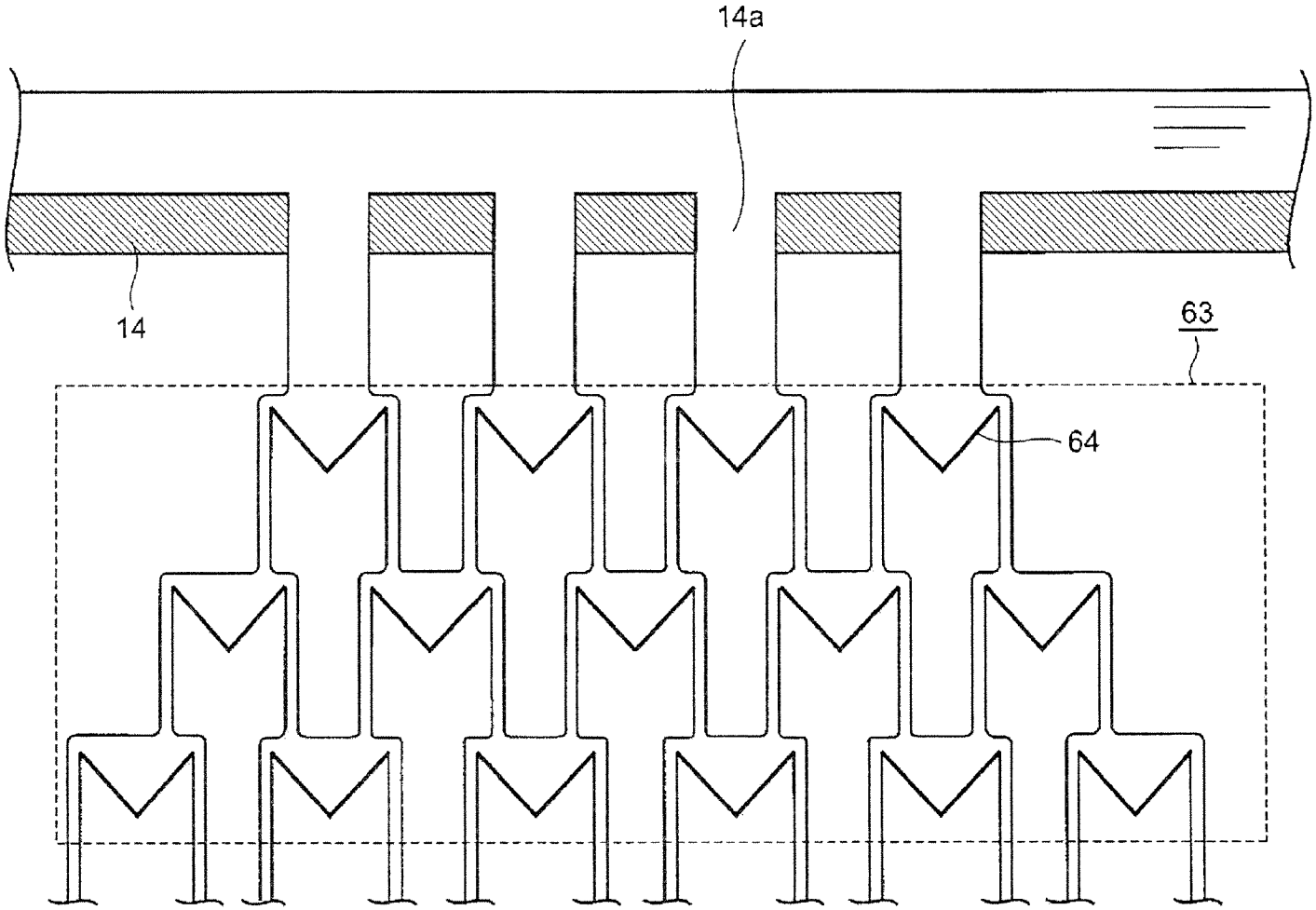
FIG. 4 is an enlarged view illustrating a structure of a deaerating tray of the multi-pressure condenser according to the third embodiment.
Figure 5:
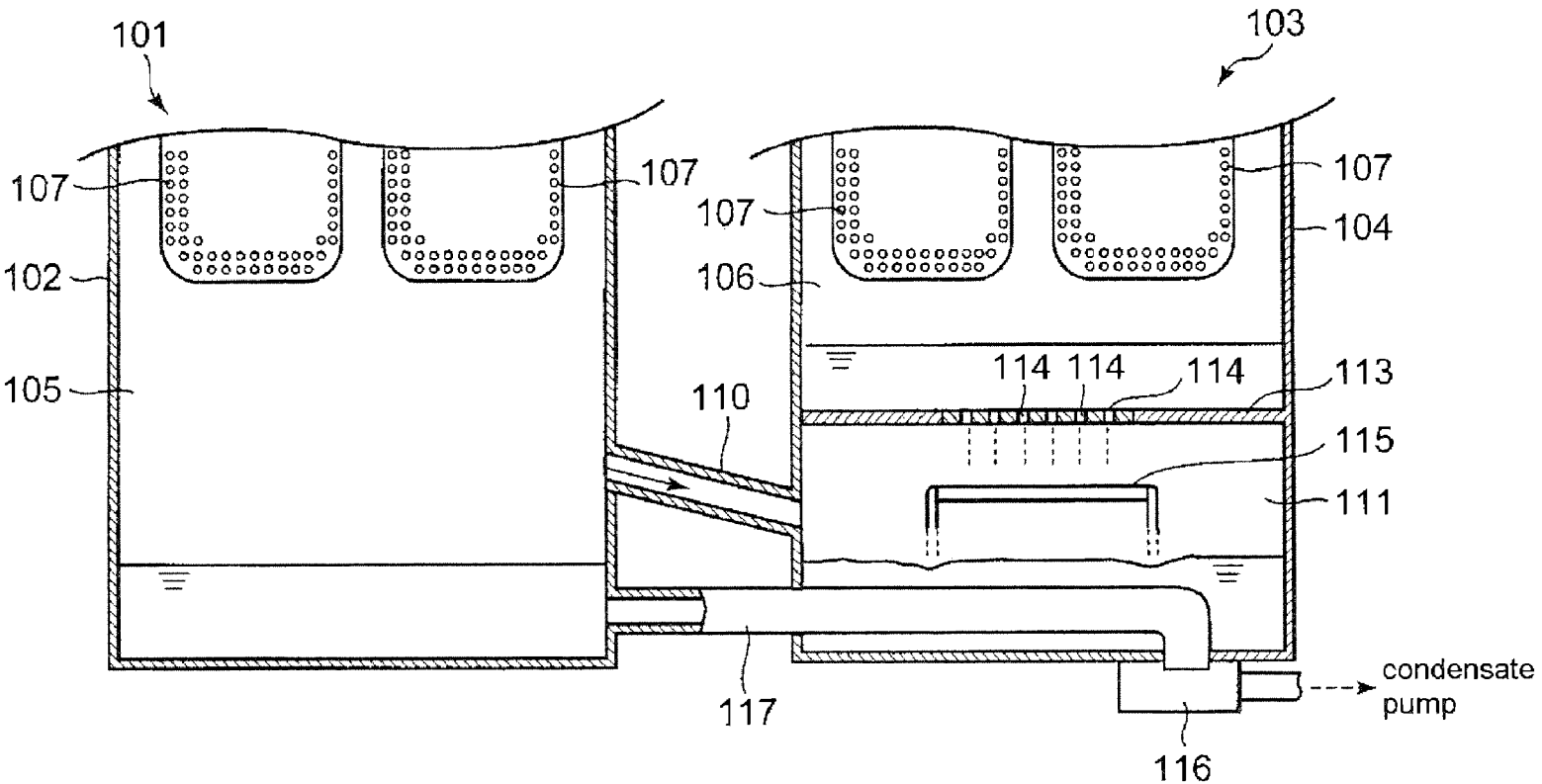
FIG.5 (PRIOR ART)
FIG. 5 is an enlarged vertical cross-sectional view illustrating the outline of a conventional multi-pressure con denser.

Details of the deaerating tray 63 will be described below with reference to FIG. 4. FIG. 4 is a view enlarging a portion in the vicinity of the deaerating tray 63. The deaerating tray 63 is constituted by a plurality of gutters 64. The condensate dropped from the pressure barrier 14 is then dropped in the hot well 15 while being diverged by the gutters 64 constituting the deaerating tray 63. That is, existence of the deaerating tray 63 increases the surface area of the condensate while the condensate is dropped from the pressure barrier 14 to the hot well 15.

Operational effects of the present embodiment will be described below.

The vent gas that has been fed from the deaerator 2 to the heat-transfer tube 81 is blown out toward the gas phase part of the hot well 15 through the holes 82 of the heat-transfer tube 81. The vent gas blown out to the hot well 15 heats the condensate accumulated in the hot well 15. At this stage, the surface area of the condensate greatly influences heat exchange efficiency. The surface area of the condensate is significantly increased by the deaerating tray 63, so that heat exchange between the vent gas and condensate can be performed with high efficiency. Further, the condensate can be deaerated by the vent gas.

Although the embodiments of the present invention has been described with reference to the accompanying drawings, a configuration obtained by arbitrarily combining the features described in each of the plurality of embodiments may be employed. For example, it is possible to combine the heat-transfer tubes of the first and the third embodiments. In this case, the vent gas can be blown out to the gas phase part of the hot well 15 after being passed through the condensate accumulated in the hot well 15.

Other Embodiments

Although the three-shell multi-pressure condenser is used to describe the above embodiments, the present invention may be applied to a two-shell multi-pressure condenser constituted by a low-pressure condenser and a high-pressure condenser or to a multi-pressure condenser constituted by four or more shells.

Further, in the above embodiments, the vent gas of the deaerator 2 is fed to the heat-transfer tube 61 so as to heat the condensate accumulated in the hot well 15. Alternatively, however, in place of the vent gas of the deaerator 2, any one or any combination of the following may be used: vent gas or drain of a high-pressure/low-pressure feed-water heater for heating feed-water to be fed to a nuclear reactor, a feed-water heater drain tank for storing the drain of a feed-water heater, and a vent or drain of other condensate/feed-water system unit such as the turbine 31; and a high-pressure/intermediate pressure/low-pressure turbine extraction steam for generating electric power using steam which is generated by heating feed-water with heat generated in the nuclear reactor.

Further, although the condensate accumulated in the hot well 15 of the low-pressure condenser 10 is heated in the above embodiment, the same effect can be obtained as long as the condensate of a condenser other than a condenser having the highest pressure among the condensers constituting the multi-pressure condenser is heated. That is, the condensate accumulated in the hot well 25 of the intermediate pressure condenser 20 may be heated in the above embodiments. Furthermore, the condensate accumulated in both the hot wells 15 and 25 may be reheated. In this case, for example, the vent gas of the deaerator 2 is diverged into the hot wells 15 and 25 so as to heat the condensate accumulated therein. Alternatively, a configuration using the vent/drain of a plurality of turbine units may be employed, in which, for example, the condensate accumulated in the hot well 15 by using the vent gas from the deaerator 2 while condensate accumulated in the hot well 25 is heated by using the drain of a feed-water heater.

What is claimed is:

1. A multi-pressure condenser having a first condenser inside which a vacuum low-pressure chamber is formed and a second condenser inside which a vacuum high-pressure chamber having a higher pressure than the low-pressure chamber is formed, the first condenser comprising:

a first cooling water tube bundle provided with a plurality of tubes which are provided so as to penetrate the low-pressure chamber and in which cooling water is distributed;

a pressure barrier which extends in horizontal direction below the first cooling water tube bundle so as to separate internal space of the first condenser into upper and lower portions, the upper portion defining the low-pressure chamber and the lower portion defining a first hot well, and which has a plurality of through holes; and a heat-transfer tube inside which fluid introduced from outside the first condenser into the first hot well is distributed, wherein a gas phase part and a liquid phase part are formed respectively at the upper and the lower portions of the low-pressure chamber, and liquid in the liquid phase part is dropped into the first hot well through the plurality of through holes to form a gas phase part and a liquid phase part at the upper and the lower portions of the first hot well, the second condenser comprising:

a second cooling water tube bundle provided with a plurality of tubes which are provided so as to penetrate the high-pressure chamber and in which cooling water is distributed, wherein condensate generated in the high-pressure chamber is accumulated below the second cooling water tube bundle to form a liquid phase part, and a gas phase part is formed above the liquid phase part, and the multi-pressure condenser further comprising:

a steam duct allowing the gas phase parts of the first hot well and the second condenser to communicate with each other; and a pipe allowing the liquid phase parts of the first hot well and the second condenser to communicate with each other, wherein fluid having a higher temperature than the condensate accumulated in the first hot well is fed to the heat-transfer tube.

2. The multi-pressure condenser according to claim 1, wherein the fluid distributed in the heat-transfer tube includes vent, drain, or extraction steam of at least one of a feed-water heater for heating feed-water to be fed to a nuclear reactor, a deaerator for deaerating the feed-water to be fed to the nuclear reactor, a feed-water heater drain tank for storing drain of the feed-water heater, and a turbine for generating electric power using steam which is generated by heating the feed-water with heat generated in the nuclear reactor.

3. The multi-pressure condenser according to claim 1, wherein the heat-transfer tube is introduced into the condensate accumulated in the first hot well.

4. The multi-pressure condenser according to claim 3, wherein the first condenser comprises, above the first cooling water tube bundle, a flush box for generating flush steam, and the heat-transfer tube is introduced into the condensate accumulated in the first hot well and the n connected to the flush box.

5. The multi-pressure condenser according to claim 1, wherein the heat-transfer tube is constituted by a tube in which holes are formed.

6. The multi-pressure condenser according to claim 1, wherein the first hot well comprises a deaerating tray for diverging the condensate dropped from the pressure barrier, and the heat-transfer tube is constituted by a tube in which holes are formed and is introduced into the gas phase part of the first hot well.

7. A method of reheating condensate of a multi-pressure condenser comprising a first condenser inside which a vacuum low-pressure chamber is formed and a second condenser inside which a vacuum high-pressure chamber having a higher pressure than the low-pressure chamber is formed, the first condenser comprising:

a first cooling water tube bundle provided with a plurality of tubes which are provided so as to penetrate the low-pressure chamber and in which cooling water is distributed;

a pressure barrier which extends in horizontal direction below the first cooling water tube bundle so as to separate internal space of the first condenser into upper and lower portions, the upper portion defining the low-pressure chamber and the lower portion defining a first hot well, and which has a plurality of through holes; and a heat-transfer tube inside which fluid introduced from outside the first condenser into the first hot well is distributed, wherein a gas phase part and a liquid phase part are formed respectively at the upper and the lower portions of the low-pressure chamber, and liquid in the liquid phase part is dropped into the first hot well through the plurality of through holes to form a gas phase part and a liquid phase part at the upper and the lower portions of the first hot well, the second condenser comprising:

a second cooling water tube bundle provided with a plurality of tubes which are provided so as to penetrate the high-pressure chamber and in which cooling water is distributed, wherein condensate generated in the high-pressure chamber is accumulated below the second cooling water tube bundle to form a liquid phase part, and a gas phase part is formed above the liquid phase part, the multi-pressure condenser further comprising:

a steam duct allowing the gas phase parts of the first hot well and the second condenser to communicate with each other; and a pipe allowing the liquid phase parts of the first hot well and the second condenser to communicate with each other, and the method of reheating condensate of the multi-pressure condenser comprising:

performing heat exchange between the vent, drain or extraction steam of at least one of: a feed-water heater for heating feed-water to be fed to a nuclear reactor pressure vessel, a deaerator for deaerating the feed-water to be fed to the nuclear reactor pressure vessel, a feed-water heater drain tank for storing drain of the feed-water heater, and a turbine for generating power using steam which is generated by heating the feed-water with heat generated in the nuclear reactor pressure vessel; and the condensate accumulated in the first hot well.

* * * * *